US006978558B2

(12) United States Patent
Grella et al.

(10) Patent No.: US 6,978,558 B2
(45) Date of Patent: Dec. 27, 2005

(54) SNOWBOARD BOOT STRAP ANCHOR

(75) Inventors: Jeffrey Grella, Newport Beach, CA (US); Jake Rivas, San Francisco, CA (US)

(73) Assignee: Vans, Inc., Santa Fe Springs, CA (US)

( * ) Notice: Subject to any disclaimer, the term of this patent is extended or adjusted under 35 U.S.C. 154(b) by 0 days.

(21) Appl. No.: 10/701,697

(22) Filed: Nov. 4, 2003

(65) Prior Publication Data

US 2004/0143999 A1 Jul. 29, 2004

Related U.S. Application Data

(60) Provisional application No. 60/442,782, filed on Jan. 27, 2003.

(51) Int. Cl.[7] ..... A43B 5/00

(52) U.S. Cl. ..... 36/50.5; 36/117.1; 36/115; 36/50.1

(58) Field of Search ..... 36/117.1, 50.5, 36/58.5, 50.1, 115, 88

(56) References Cited

U.S. PATENT DOCUMENTS

| | | | | |
|---|---|---|---|---|
| 6,009,638 | A | 1/2000 | Maravetz et al. | 36/115 |
| 6,056,300 | A * | 5/2000 | Carpenter et al. | 280/14.22 |
| 6,061,870 | A * | 5/2000 | Dodge et al. | 16/2.1 |
| 6,253,467 | B1 | 7/2001 | Maravetz et al. | 36/115 |
| 6,446,362 | B1 | 9/2002 | Martin et al. | 36/117.1 |
| 6,729,047 | B2 * | 5/2004 | Hirayama | 36/50.5 |
| 2003/0154631 | A1 * | 8/2003 | Hirayama | 36/117.1 |

* cited by examiner

*Primary Examiner*—M. D. Patterson
(74) *Attorney, Agent, or Firm*—Winston & Strawn LLP

(57) ABSTRACT

A snowboard boot strap anchor is described. The strap anchor includes a raised portion having at least three mounting locations, and a thin base portion associated with the raised portion for attachment to an upper portion of the snowboard boot. Also described is a snowboard boot strap mounting system. The system includes a first strap anchor having a raised portion containing at least three mounting locations, the strap anchor including a base portion for attachment to the snowboard boot upper, an ankle strap arrangement having a first distal end for attachment to the first strap anchor, and a fastener device for connecting the first distal end of the ankle strap arrangement to the first strap anchor by mating with a selected mounting location.

13 Claims, 2 Drawing Sheets

SNOWBOARD BOOT STRAP ANCHOR

This application claims the benefit of U.S. Provisional Application No. 60/442,782 filed on Jan. 27, 2003 now abandoned.

BACKGROUND ART

This invention generally relates to a snowboard boot anchor for use with a strap arrangement.

In the sport of snowboarding, various types of bindings are known for securing a rider's boot to the snowboard. One type of binding includes adjustable heel and toe members to secure a hard shell boot to a snowboard. Another type of binding utilizes a rigid high back and straps to secure a soft-shelled boot to a snowboard. Yet another type is a step-in type of binding that includes components for mating with interface means attached to the lower portion of the snowboard boots.

Step-in type bindings eliminate the need for straps attached to the binding. But to prevent a rider's foot, and particularly the heel, from lifting within the snowboard boot used with such a step-in system, an ankle strap is typically provided on the outside surface of the upper of the boot and tightened by the wearer to secure the heel. The ankle strap has fixed medial and lateral attachment points on the upper portion of the boot.

Conventional ankle straps are attached directly to the lateral and medial surfaces of the upper of a boot and employ at least one ratcheting mechanism to tighten a first strap component on the medial side with respect to a second strap on the lateral side. The end contact points of the straps on the lateral and medial upper surfaces are fixed, and thus a rider has no way to adjust the placement of the ankle strap. Such an ankle strap arrangement can cause uncomfortable pressure points to occur on the rider's foot. If the ankle strap is not comfortable, a rider may not adequately tighten it about the boot. A loose ankle strap results in heel lift during riding and thus reduced control of the snowboard.

SUMMARY OF THE INVENTION

Presented is a strap anchor member which acts as an interface for attachment of an ankle strap arrangement to the snowboard boot upper. Strap anchors according to the invention include a raised portion having at least three mounting locations, and a thin base portion associated with the raised portion for attachment to an upper portion of the snowboard boot.

In an advantageous embodiment, the strap anchor may be a unitary member, and may be made of at least one of a plastic, rubber, a composite material or metal material. It is desirable for at least one mounting location to include a sleeve for receiving a fastener device, and/or at least one mounting location to include a means for receiving a toolless fastener. The raised portion may have a height that is equal to a percentage of the combined thickness of at least two straps of a strap arrangement.

Another implementation according to the invention pertains to a snowboard boot strap mounting system. The system includes a first strap anchor having a raised portion containing at least three mounting locations, the strap anchor including a base portion for attachment to a snowboard boot upper, an ankle strap arrangement having a first distal end for attachment to the first strap anchor, and a fastener device for connecting the first distal end of the ankle strap arrangement to the first strap anchor by mating with a selected mounting location.

In an advantageous variation, the first strap anchor is attached to the medial side of the snowboard boot upper and a second distal end of the strap arrangement is connected to the lateral side of the snowboard boot upper. In another variation, the system further includes a second strap anchor having at least three mounting locations and a base portion for attachment to the snowboard boot upper. The second strap anchor may be attached to the lateral side of the snowboard boot upper and a second distal end of the strap arrangement may be configured for attachment to a selected mounting location of the second strap anchor.

Yet another aspect according to the invention pertains to a snowboard boot. The snowboard boot includes an outsole, an upper connected to the outsole, an ankle strap arranged to overlie the upper and having first and second distal ends attached to first and second attachment locations, the ankle strap having an adjustable length, and at least one strap anchor. The strap anchor includes a raised portion containing at least three mounting locations and a thin base portion and is affixed to the boot upper in at least one of the first and second attachment locations. At least one of the distal ends of the ankle strap is removably mounted to a selected mounting location of the strap anchor.

In advantageous implementations, a fastener device is included for connecting the first distal end of the ankle strap arrangement to the strap anchor by mating with a selected mounting location. In a desirable variation, a second strap anchor having at least three mounting locations and a base portion is attached to the other of the first and second attachment locations. It is contemplated that the strap anchor raised portion has a height that is equal to a percentage of the combined thickness of at least two straps of the ankle strap arrangement.

The invention permits an instep pad of an ankle strap arrangement to be tightened comfortably without creating undesirable pressure points. This encourages the rider to obtain a snug fit. A snug fit is desirable to minimize heel lift during snowboarding maneuvers, which enables the rider to enjoy better control of the snowboard.

BRIEF DESCRIPTION OF THE DRAWINGS

Other aspects, purposes and advantages of the invention will become clear after reading the following description with reference to the attached drawings, in which.

Like reference symbols in the various drawings indicate like elements.

DETAILED DESCRIPTION OF THE PREFERRED EMBODIMENTS

Figure 1:
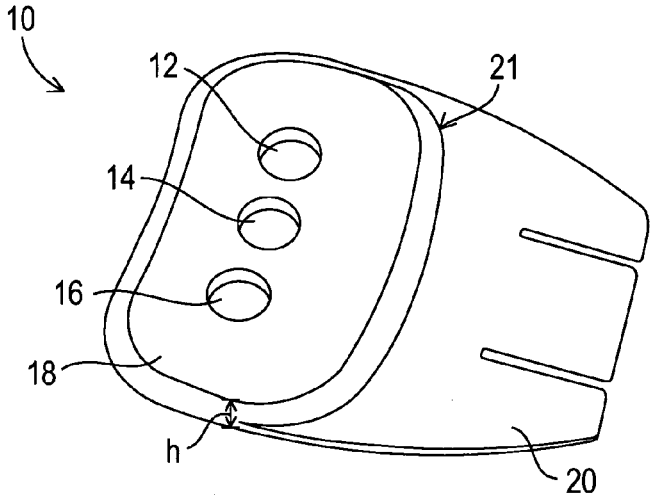
FIG. 1 illustrates a strap anchor according to the invention.

FIG. 1 illustrates an implementation of a strap anchor 10 according to the invention. The strap anchor 10 includes a plurality of mounting holes 12, 14 and 16 that may include connection means, such as a metal sleeve (not shown). Although three mounting holes are shown, which gives a rider three choices or selections for connecting one end of a strap, more mounting holes to increase the amount of possible mounting locations could be provided. In addition, the mounting holes could be arranged in another configuration instead of in a straight line as shown. For example, a plurality of mounting holes could be arranged in several rows, and/or may be clustered to occupy the majority of the raised surface area.

The strap anchor 10 has a raised surface 18 having a height "h" and a thin connection area 20 after an interface portion 21. The thin connection area is used to attach the strap anchor to a sports boot. The thickness or height h of the raised surface 18 may be uniform, or may vary from one portion to another. The height h may also depend upon the thickness of the strap arrangement or straps that will be used with the boot. For example, the thickness h may be equal to a percentage of the combination of two straps or other elements that will overlie each other when tightened. In an implementation, the thickness h may be greater than 75 percent of the combined thickness of a medial strap 44 and an instep pad 46 (shown in FIGS. 2 and 3). The thickness h may also depend upon the material used to manufacture the strap anchor, and/or the type of mounting holes required to accommodate the particular type of fasteners to be used. In addition, the thickness h may depend on the number of mounting holes provided. For example, if more than three mounting holes are provided, the thickness h may be greater than that used for three mounting holes. In any case, care must be taken to ensure that the configuration and number of mounting holes does not weaken the strap anchor to the point that the raised surface portion 18 may rip or tear due to any tensioning stress that may occur either when adjustments are being made during fitting or during use of the boot. Care must also be taken that any such configuration and number of mounting holes results in a raised surface portion 18 that is sufficiently resilient to ensure that a fastening means will not inadvertently disengage during use.

It should also be understood that the overall shape of the raised surface 18 may be different than the generally rectangular shape shown in FIG. 1. For example, the raised surface could be diamond-shaped, or circular, or some other shape to better match the overall design of a particular snowboard boot. The shape of the raised surface may also be chosen to satisfy certain criteria, such as to provide desired aerodynamic qualities. The surface area of the raised surface 18 could also be larger to accommodate a greater number of mounting holes.

The generally flat surface shape of the strap anchor 10 provides for a stable anchoring device when attached to an upper of a snowboard boot. The strap anchor may also be slightly contoured or curved to follow the contours of the boot upper. The strap anchor may be molded as a single unitary member, or may be constructed of separate components. Suitable materials for use in fabricating the strap anchor may include plastic, rubber, metal, a composite material or other durable material. In general, lightweight, durable and resilient materials are preferably utilized to manufacture the strap anchor. It is contemplated that one strap anchor attached in the ankle area as shown in the figures, or a pair of strap anchors attached on opposite sides (the lateral and medial sides) of a snowboard boot upper in the ankle area, may be used to accommodate a strap arrangement.

Figure 2:
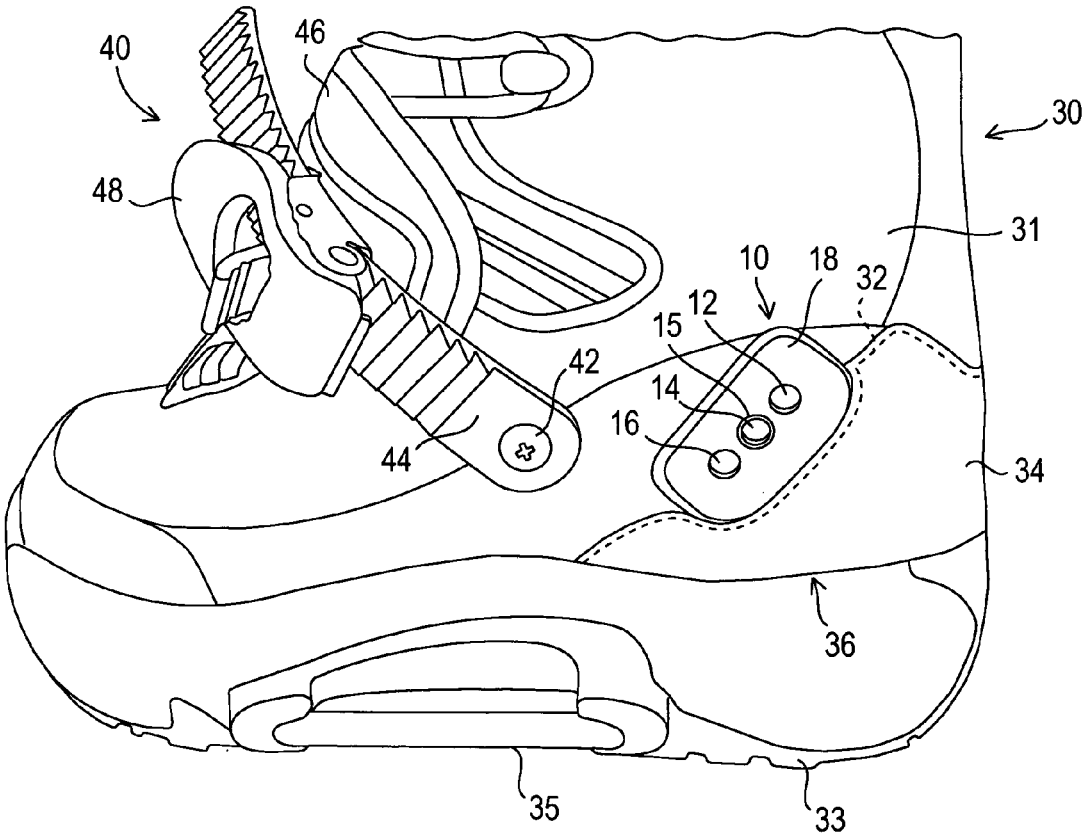
FIG. 2 is a medial side view of a portion of a snowboard boot that includes an ankle strap and the strap anchor of FIG. 1.

FIG. 2 is a medial side view of a portion of a snowboard boot 30 that includes the strap anchor 10 of FIG. 1. The snowboard boot 30 includes an upper portion 31 and a sole portion 33 having an associated mounting bale 35 for use with a step-in binding system (not shown). But it should be understood that the strap anchor 10 is not limited to use with this type of boot or mounting system, and could be used with sport boots of any type.

In the implementation shown in FIG. 2, the strap anchor 10 is secured to the ankle area of the boot by stitching 32, wherein the stitches pierce the thin connection area 20 near or at the interface 21 (see FIG. 1) to affix the strap anchor to the footwear. In this embodiment, the entire connection area 20 of the strap anchor is hidden beneath a boot upper material layer 34. It should be understood that other materials, such as rivets or adhesive, can be used to attach the strap anchor to the upper of an article of footwear such as the boot shown in the figures. A distal portion of the connection area 20 may also be secured by the topmost portion 36 of the outsole 33. Another strap anchor (not shown) may be attached on the lateral side of the boot in a similar manner and in the ankle area.

As shown in FIG. 2, the raised surface 18 of the strap anchor 10 extends outwardly from the snowboard boot outer surface. In the arrangement shown, the mounting hole; 14 includes a sleeve 15 with threads to accept a mounting screw 42 having mating threads (not shown) which is seated on a medial ankle strap 44 of an ankle strap arrangement 40. It should be understood, however, that one skilled in the art would recognize that other types of connection means or fastening devices could be used instead of a screw and sleeve, such as a screw and threaded T-nut, a key-type fastener, a snap fastener, a slot and hook-type fastener, or tool-less fasteners, or other connectors that are known. It should also be understood that the screw 42 could have a flat head with a large slot to enable a rider to use a coin or other tool to tighten or loosen the screw.

Figure 3:
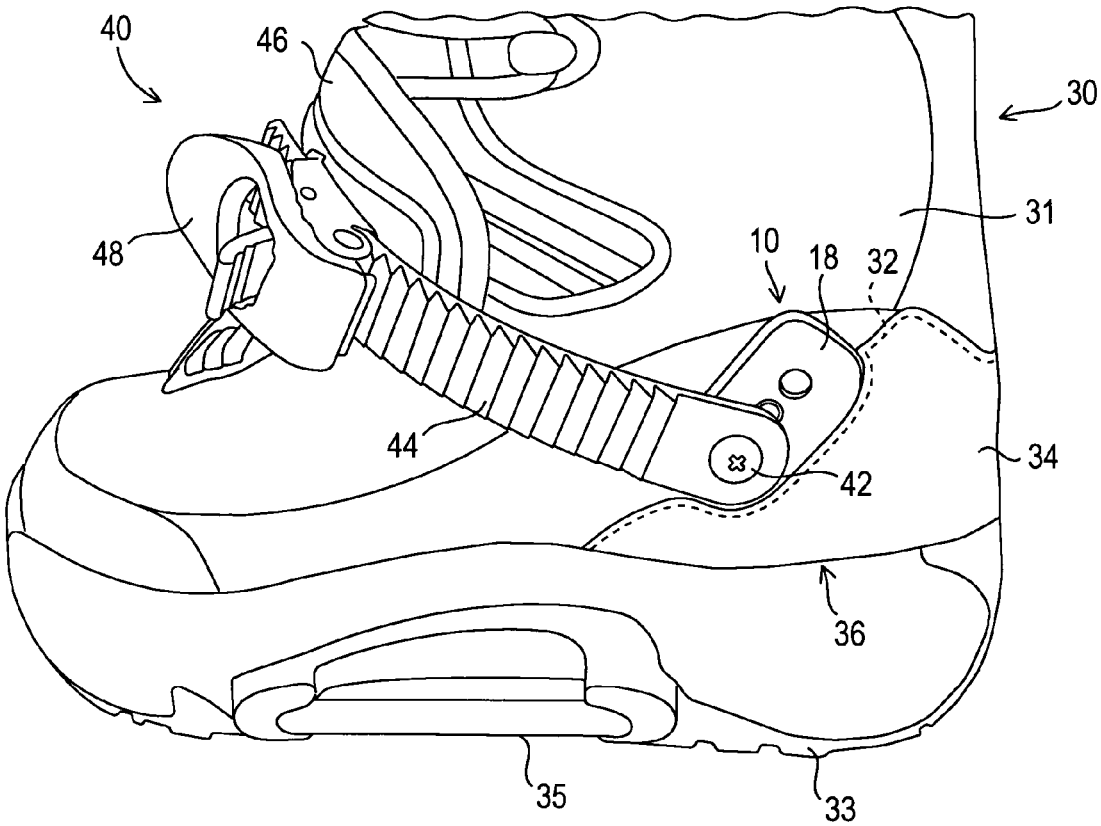
FIG. 3 is another medial side view of a portion of a snowboard boot that includes an ankle strap connected to the strap anchor of FIG. 1.

FIG. 3 is another medial side view of a portion of a snowboard boot 30 that includes a medial strap 44 connected to the strap anchor 10 of FIG. 1. In this implementation, the medial strap 44 is connected to the lowermost mounting hole 16 of the strap anchor 10 via a mounting screw 42. The medial strap 44 includes teeth that mate with teeth of a ratchet mechanism 48 that a rider uses to tighten the ankle strap arrangement 40. As mentioned above, a second strap anchor (not shown) may be connected to the snowboard boot lateral side to provide added selection possibilities for the wearer of the sport boot. For example, if two strap anchors are provided, one on the lateral side and the other on the medial side of the sports boot upper, the ankle strap arrangement 40, which overlies the upper in the tongue area of the boot, can be connected in nine different positions. Thus, a rider can adjust the attachment position of the ankle strap to change the angle of the strap arrangement and obtain a custom fit by utilizing any of the available mounting holes on either side of the boot. The advantage of such a variable adjustment system is that a rider can obtain a snug, comfortable fit while minimizing pressure points across the instep pad 46. Thus, such a configuration can overcome or accommodate any fit issues that a particular rider may have to enable that rider to achieve a comfortable and secure fit. The strap anchors are thus biomechanically oriented to work with different size feet, so that an individual will use ratchet mechanism 48 to tighten the medial strap 44 and the lateral strap (not shown) to obtain a snug fit to prevent heel lift of the foot during use of the snowboard boot. The strap anchor is therefore a resilient anchoring device that permits the wearer of the boot to customize the fit of an ankle strap to conform to the fit requirements of that particular person.

In addition, the raised surface 18 of the strap anchor 10 functions to create space between the strap components, such as medial strap 44, and the surface of the boot so that the straps can slide more freely relative to each other. For example, the instep pad 46 can easily slide beneath the medial strap 44 as the ratchet mechanism 48 is used to tighten the straps. This helps to minimize friction between the straps and the sports boot upper that could create unwanted and uncomfortable pressure points. Furthermore, such a snowboard boot strap mounting system permits the easy replacement of any strap, such as medial strap 44, if it becomes worn or damaged.

An embodiment of the invention has been described. Nevertheless, it will be understood that various modifications may be made without departing from the spirit and scope of the invention. For example, more than three mounting holes could be utilized to offer more mounting choices to a rider, and the strap anchor could be attached to other portions or areas of an upper of a snowboard boot. Accordingly, other embodiments are within the scope of the following claims.

What is claimed is:

1. A snowboard boot strap mounting system comprising:

an ankle strap arrangement including an instep pad;

a first strap anchor operatively associated with the ankle strap arrangement, and having a raised portion with a height equal to at least seventy-five percent of the combined thickness of an ankle strap and the instep pad to provide sufficient space for the instep pad to slide beneath the ankle strap, and wherein the strap anchor raised portion comprises at least three separate mounting locations, the strap anchor including a base portion for attachment to a snowboard boot upper and the ankle strap arrangement having a first distal end for attachment to the first strap anchor; and a fastener device for connecting the first distal end of the ankle strap arrangement to the first strap anchor by mating with a selected mounting location.

2. The system of claim 1 wherein the first strap anchor is attached to the medial side of the snowboard boot upper and a second distal end of the strap arrangement is connected to the lateral side of the snowboard boot upper.

3. The system of claim 1 further comprising a second strap anchor having a raised portion with a height equal to at least seventy-five percent of the combined thickness of the ankle strap and the instep pad, wherein the raised portion comprises at least three separate mounting locations, and a base portion for attachment to the snowboard boot upper.

4. The system of claim 3 wherein the second strap anchor is attached to the lateral side of the snowboard boot upper and a second distal end of the strap arrangement is configured for attachment to a selected mounting location of the second strap anchor.

5. The system of claim 1 wherein at least one mounting location includes a sleeve for receiving a fastener device.

6. The system of claim 1 wherein at least one mounting location includes a means for receiving a tool-less fastener device.

7. The system of claim 1 wherein the first strap anchor raised portion has a height that is equal to at least seventy-five percent of the combined thickness of at least two straps of the ankle strap arrangement.

8. A snowboard boot comprising:

an outsole;

an upper connected to the outsole;

an ankle strap arrangement including and instep pad arranged to overlie the upper and having first and second distal ends attached to first and second attachment locations, the ankle strap arrangement having an adjustable length; and at least one strap anchor that includes a raised portion with a height equal to at least seventy-five percent of the combined thickness of an ankle strap and the instep pad to provide sufficient space for the instep pad to slide beneath the ankle strap and comprising at least three separate mounting locations, and a thin base portion, the strap anchor affixed to the boot upper in at least one of the first and second attachment locations;

wherein at least one of the distal ends of the ankle strap is removably mounted to a selected mounting location of the strap anchor.

9. The snowboard boot of claim 8 further comprising a fastener device for connecting the first distal end of the ankle strap arrangement to the strap anchor by mating with a selected mounting location.

10. The snowboard boot of claim 8 further comprising a second strap anchor having a raised portion with height equal to at least seventy-five percent of the combined thickness of the ankle strap and instep pad and comprising at least three separate mounting locations, and a base portion attached to the other of the first and second attachment locations.

11. The snowboard boot of claim 8 wherein at least one mounting location includes a sleeve for receiving a fastener device.

12. The snowboard boot of claim 8 wherein at least one mounting location includes a means for receiving a tool-less fastener device.

13. The snowboard boot of claim 8 wherein the strap anchor raised portion has a height that is equal to at least seventy-five percent of the combined thickness of at least two straps of the ankle strap arrangement.

* * * * *

UNITED STATES PATENT AND TRADEMARK OFFICE

CERTIFICATE OF CORRECTION

PATENT NO. : 6,978,558 B2
DATED : December 27, 2005
INVENTOR(S) : Grella et al.

It is certified that error appears in the above-identified patent and that said Letters Patent is hereby corrected as shown below:

Column 6,
Line 12, after "an ankle strap arrangement including" delete "and" and insert -- an --.

Signed and Sealed this

Twenty-first Day of February, 2006

JON W. DUDAS
*Director of the United States Patent and Trademark Office*